United States Patent [19]

Overmyer et al.

[11] 3,979,551

[45] Sept. 7, 1976

[54] ARC FURNACE FUMES CONTROL SYSTEM

[75] Inventors: Robert C. Overmyer; Pramodh Nijhawan, both of Indianapolis, Ind.

[73] Assignee: Hawley Manufacturing Corporation, Indianapolis, Ind.

[22] Filed: Sept. 24, 1975

[21] Appl. No.: 616,155

[52] U.S. Cl. ..... 13/10

[51] Int. Cl.[2] ..... F27D 17/00

[58] Field of Search ..... 13/9, 10, 33, 1; 98/115 R

[56] References Cited

UNITED STATES PATENTS

| | | | |
|---|---|---|---|
| 2,908,737 | 10/1959 | De Dominicis | 13/10 |
| 3,539,692 | 11/1970 | Heeney | 13/9 |
| 3,876,418 | 4/1975 | Baum | 13/33 X |

*Primary Examiner*—R. N. Envall, Jr.

*Attorney, Agent, or Firm*—Jenkins, Hanley & Coffey

[57] ABSTRACT

For use with an electric arc melting furnace having a crucible and an upwardly directed mouth covered by a roof, and a device coupled to the roof for projecting it upwardly along an axis and pivotally about the axis to a position out of registry with the mouth for providing access for charging the furnace, and a device for tilting the furnace for tapping and slagging, a fumes exhaust system comprising an exhaust fan, a telescoping main fumes exhaust duct flexibly coupled at one end to the exhaust fan, a coupler flexibly connected to the other end of the main fumes exhaust duct and a tapping and melting manifold and hood flexibly and telescopically connected to the coupler. The tapping and melting manifold and hood are connected to the roof and project vertically along the roof axis and pivot about the roof axis with the roof to a position out of registry with the mouth. A slagging manifold and hood are mounted on the furnace and connected to the coupler. The fumes exhaust system includes a charging hood adapted for movement into close, overlying relationship with the furnace mouth when the tapping and melting manifold and hood are withdrawn from registry therewith, the charging hood having an opening in its top through which the charging bucket is lowered, the charging hood being in communication with the slagging manifold when the charging hood is in overlying relationship with the furnace mouth. The charging hood is constructed to provide for air movement past the mouth and into the slagging manifold for exhausting fumes and dust evolved during charging of the furnace into the main fumes exhaust duct.

14 Claims, 5 Drawing Figures

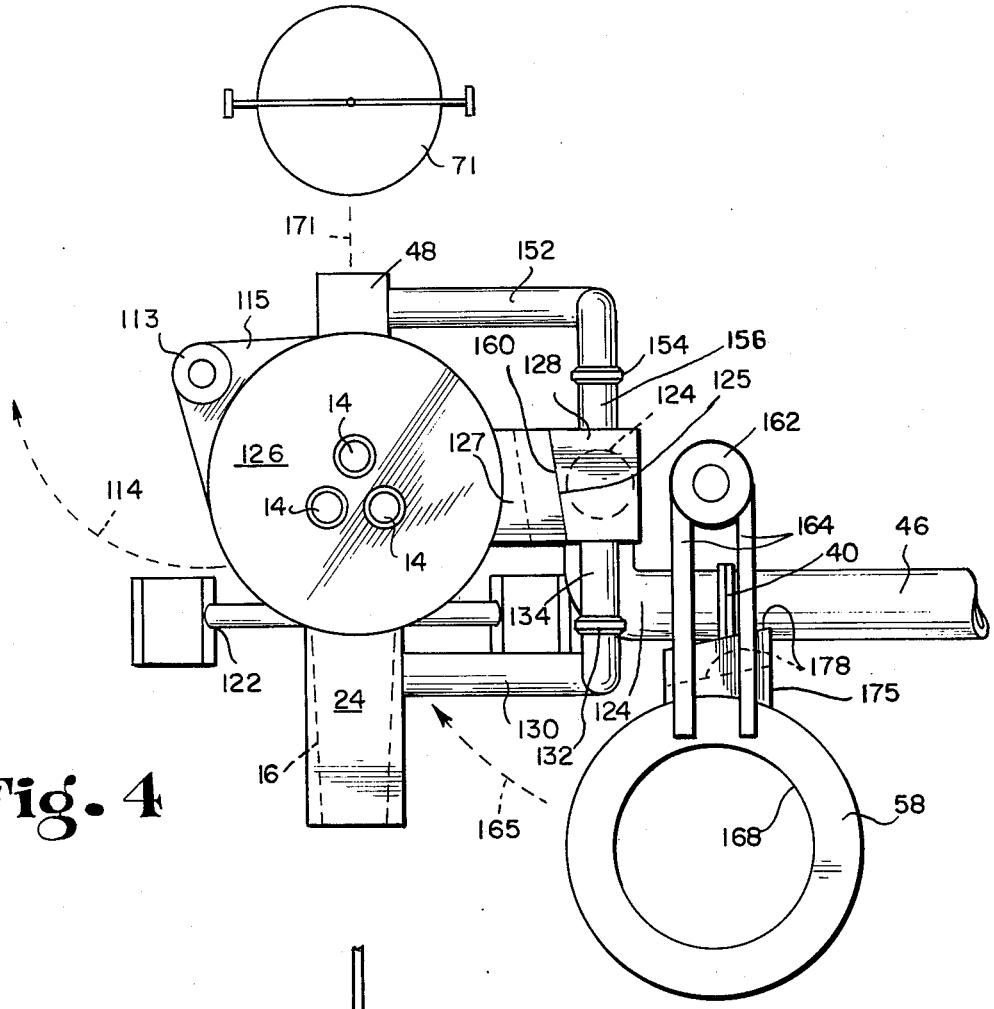
Fig. 4
Fig. 5
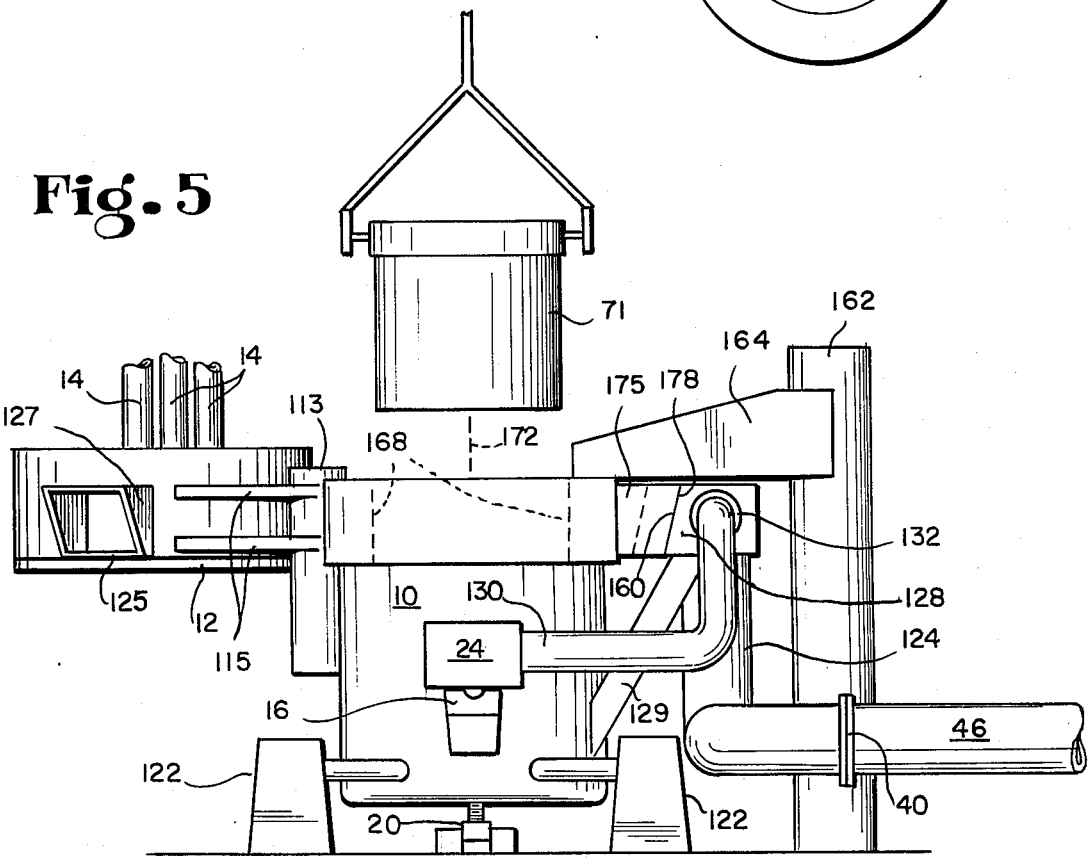

ARC FURNACE FUMES CONTROL SYSTEM

This invention relates to fumes exhaust systems for electric metal melting furnaces.

In an electric metal melting furnace of the type which comprises a crucible tiltable about one or more axes for tapping and slagging operations and further containing orifices for such operations, the exhausting of fumes generated during charging tapping, slagging and melting is a problem which has caused great concern for environmental and health reasons. Generally, such furnaces tilt forwardly for tapping and rearwardly for slagging such that the pouring spout extends forwardly and the slagging opening opens rearwardly. Since the top of such a furnace is generally closed by a roof having perforations therethrough through which a plurality of electrodes protrude for providing electrical power to melt metal with which the furnace is charged, it is necessary to provide means closely spaced above the roof to provide the necessary fumes exhaust for the considerable amount of fumes generated during the melting operation.

Examples of systems which are addressed to these problems are U.S. Pat. No. 2,268,918 issued to Allen, et al., U.S. Pat. No. 3,021,376 issued to Vedder, et al., and U.S. Pat. No. 2,908,737 issued to Dominicis. The exhaust system of the U.S. Pat. No. 2,908,737 patent, for example, provides two fumes collecting ports closely spaced to the tapping and slagging orifices. Although the ports may remain coupled to the main fumes exhaust ductwork of that patent during melting, tapping and slagging operations, the collecting ports are not integral with the furnace and thus some fumes may escape from the furnace during tapping, slagging and melting operations.

Likewise it may be seen that during the charging operation when the furnace roof is moved out of registry with the mouth of the furnace to allow lowering entry of a charging bucket through the furnace mouth, the collecting ports must also be swung outwardly away from the mouth of the furnace. But, since considerable amounts of dust and fumes may be evolved during the charging operation, it is desirable to have some provision made for exhausting duct and fumes generated during charging of the furnace.

It is thus an object of the present invention to provide an integral fumes exhaust system for an electric metal melting furnace which provides fumes exhaust during tapping, slag discharge, charging and melting and oxygen lancing operations.

Other and further objects of the present invention will become obvious to those skilled in the art to which it pertains as this specification progresses.

In accordance with the present invention, a melting furnace fumes exhaust system is provided for a furnace having a crucible and an upwardly directed mouth covered by a roof adapted for being projected vertically upwardly along an axis and pivotally about the axis to a position out of registry with the mouth for providing access for charging the furnace, which furnace is tiltable for tapping and slagging. The fumes exhaust system comprises an exhaust fan or blower, a telescoping main fumes exhaust duct flexibly coupled at one end to the exhaust fan, a coupler flexibly connected to the other end of the main fumes exhaust duct and a tapping and melting manifold and hood. The tapping and melting manifold and hood move with the roof to a position out of registry with the mouth. The tapping and melting manifold is further flexibly and telescopically connected to the coupler for remaining connected to said duct when the manifold is moved to a position out of registry with the mouth. A slagging manifold and hood are mounted on the furnace over the slapping opening and connected to the coupler, the flexing and telescoping action of the main duct allowing the slagging manifold and hood to remain connected thereto for withdrawal of fumes generated by slagging when the furnace is tilted rearwardly. A charging hood is adapted for movement into close, overlying relationship with the mouth when the roof and tapping and melting manifold and hood are withdrawn from registry therewith. The charging hood has an orifice in its top through which the charging bucket is lowered and means for coupling the charging hood to the slagging manifold when the charging hood is in overlying relationship with the mouth. The charging hood further comprises means for allowing air to be drawn therethrough, past the mouth, and into the slagging manifold for exhausting fumes and dust evolved during charging of the furnace.

As used herein, "flexible" means capable of being changed in direction or orientation without breaking, i.e., not stiff. Flexible is thus meant to include "swivelling", "pivoting" and "telescoping", etc.

The invention may best be understood by reference to the following description and accompanying drawings of which:

Figure 1:
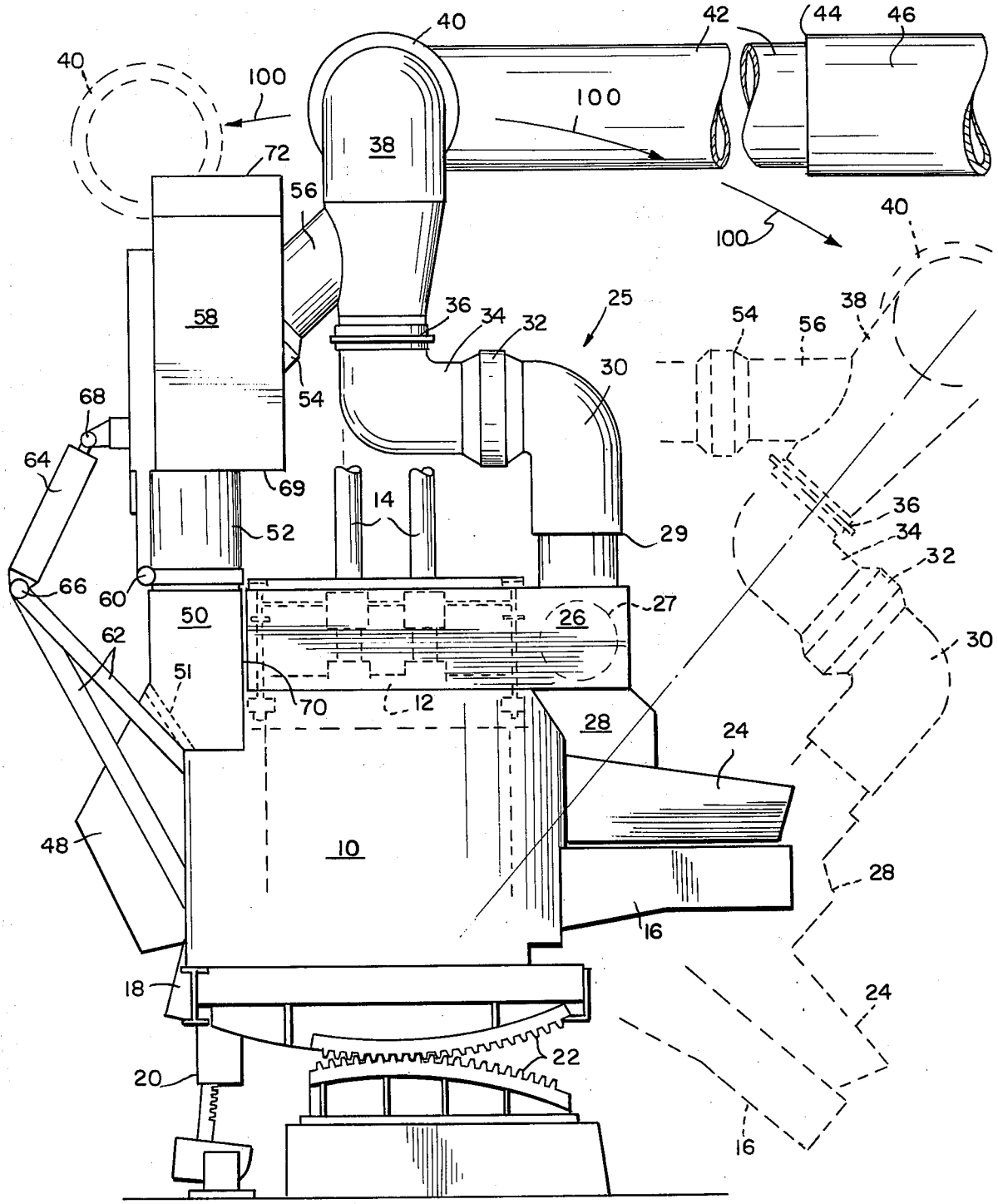
FIG. 1 illustrates a side view of a furnace and fumes exhaust system constructed in accordance with the invention, some of the dashed lines of which partially illustrate positions of the exhaust ducts, hoods and manifolds when the furnace is tilted for slag discharge or tapping of the furnace for removal of product therefrom.
Figure 3:
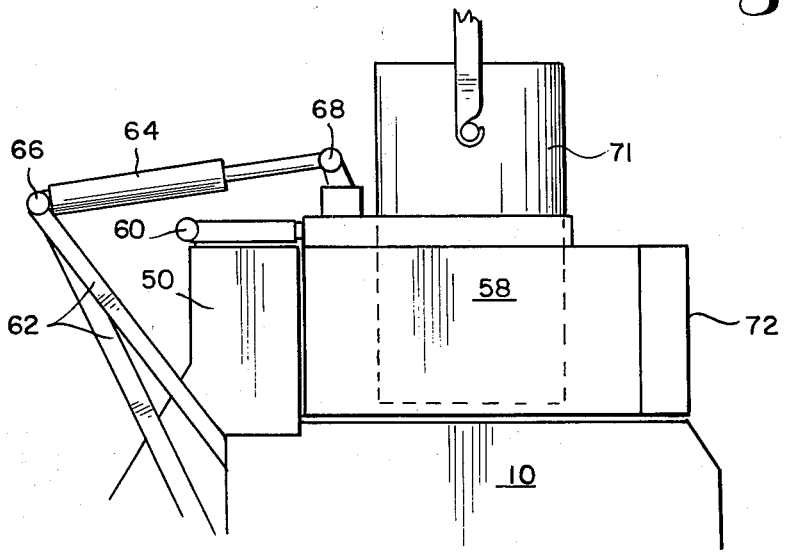

FIG. 3 illustrates a side view of a detail of the furnace and fumes exhaust system as shown in FIG. 1 and including a charging bucket; and FIGS. 4–5 are diagrammatic top and front elevations, respectively, of a furnace incorporating an alternative embodiment of the invention, some of the dashed lines of which partially illustrate movement of exhaust ducts, hoods and manifolds during various furnace operations.

Figure 2:
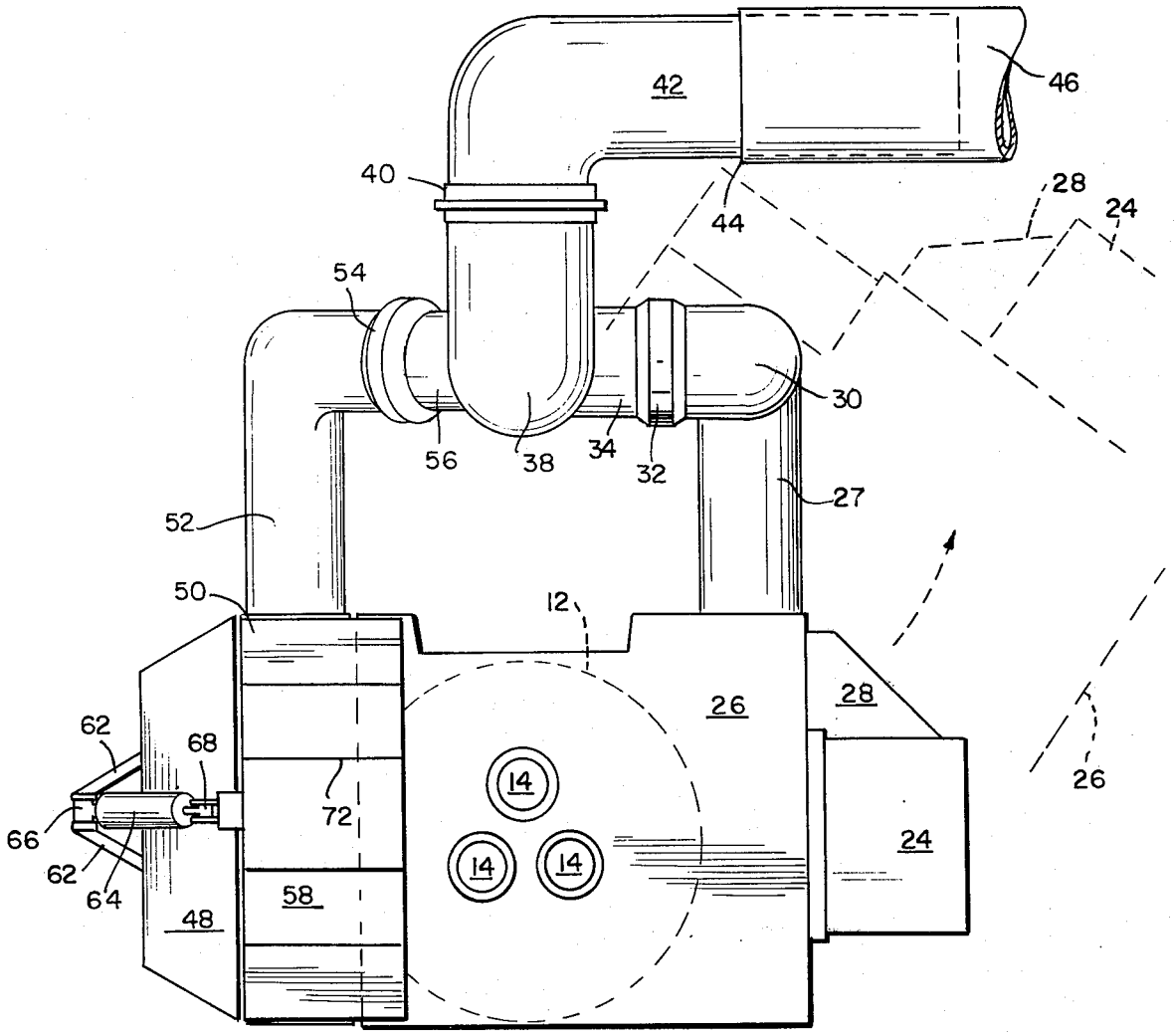
FIG. 2 illustrates a partial top view of the furnace and fumes exhaust system of FIG. 1, some of the dashed lines of which partially illustrate positions of exhaust ducts, hoods and manifolds when the roof is moved out of registry with the furnace mouth for charging.

In the furnace and fumes exhaust system illustrated in FIGS. 1–3, a crucible 10 of an electric arc furnace for melting metal has an upwardly directed mouth covered during melting operations by a roof 12. A plurality of electrodes 14 which supply electricity for melting of metal in the furnace protrude vertically through perforations in roof 12. Roof 12 is conventionally adapted for removal from the furnace mouth by projecting vertically upwardly a short distance and then transversely out of registry with the mouth by a conventional lifting and pivot mechanism (not shown).

Crucible 10 also has a spout 16 communicating through the side wall thereof through which molten metal flows when the furnace is tilted forwardly to the position indicated by dashed lines and arrows 100 of FIG. 1 for tapping. When the furnace is tilted rearwardly for slag discharge, slag flows from the crucible 10 outwardly through an orifice in the side wall thereof and through slagging door 18. The furnace is conventionally tilted by a tilting mechanism 20 upon rocker gears 22.

Coupled in overlying relationship with spout 16 is a fumes exhaust hood 24 for collecting fumes generated as molten metal pours from said spout as the furnace is tapped. A combined tapping and melting fumes exhaust manifold and hood 26 through which pass fumes generated during the melting cycle, as well as those generated during tapping, overlies furnace roof 12 and extends into the region of the roof adjacent the protruding electrodes 14. Since considerable amounts of fumes are evolved in the region of the electrodes during the melting cycle, it is advantageous to have hood 26 extend as far into the region of the electrodes as possible and to have openings therein proximate the perforations in the roof 12 through which electrodes 14 extend for collecting fumes generated during the melting cycle. As it may thus be advantageous for hood 26 to surround electrodes 14 as shown in FIG. 2, hood 26 is made to be lifted slightly and pivoted with the roof 12 as roof 12 moves to a position out of registry with the furnace mouth.

Tapping fumes exhaust hood 24 and tapping and melting fumes exhaust manifold and hood 26 are connected together by a duct section 28. Both tapping and melting exhaust manifold and hood 26 and tapping fumes exhaust hood 24 are then coupled to an exhaust fan means (not shown) which draws air through the hoods during furnace operations to collect fumes generated during melting and tapping.

Hood 24 and hood and manifold 26 are also coupled through a section of conduit 25 which includes a first vertically rising right angle bend 27, a sliding, i.e., telescoping, joint 29, a second right angle bend 30, a selectively variable damper 32, a vertically rising right angle bend 34, a swivel joint 36 which has a vertically extending swivel axis coinciding with the pivot axis of roof 12 in the solid line position of FIG. 1, a larger right angle bend section 38 and a swivel joint 40 connecting to a main fumes exhaust duct having a right angle bend section 42 which fits telescopingly at joint 44 into a pipe section 46 which is coupled at its other end to the exhaust fan means. The swivel joint 40 has a horizontal swivel axis which intersects the vertical axis of the swivel joint 36.

Overlying slag discharge door 18 is a slagging fumes exhaust hood 48. Hood 48 is coupled to a slagging fumes exhaust manifold 50. A damper 51 may be used to dampen off the slagging hood 48 as necessary. From manifold 50, fumes are conducted through a duct section 52, a selectively controllable damper 54 and a short duct section 56 into duct section 38 and thence into the main fumes exhaust duct.

The dampers 32 and 54 are provided for selectively varying the amount of air flow through respectively the tapping and melting manifold and the slagging manifold as the furnace operations change.

Swivel joint 40, telescoping joint 44 and an additional right angle bend and swivel joint (not shown) at the point where duct section 46 is connected to the exhaust fan means allow the end of the main duct which is connected to the furnace duct system at swivel 40 to elevate, extend and contract as the arrows 100 and dashed lines in FIG. 1 illustrate. Thus, the tapping and melting fumes exhaust hood and manifold 26 and the slagging hood 48 remain connected to the main fumes exhaust hood during tapping and slag discharge operations.

The face 70 of slagging fumes exhaust manifold 50 abutting tapping and melting hood and manifold 26 has one or more openings thereon which are sealed by the abutting face of hood and manifold 26 when hood and manifold 26 is in the position shown in solid lines in FIG. 1 for the melting and tapping phases of furnace operation. To prepare the furnace for charging, however, furnace roof 12 and tapping hood 24 and melting and tapping manifold and hood 26 are projected vertically upwardly a slight amount and moved to a position out of registry with the mouth of the furnace exposing the openings in the aforementioned face of slagging manifold 50. A charging hood 58 which is supported by hinged connection 60 from the top of manifold 50 is projected downwardly into overlying relationship with the top of crucible 10.

The lowering and raising apparatus for hood 58 comprises a plurality of charging hood supports 62 attached to the back of crucible 10 and a controllable hydraulic cylinder 64 pivotally connected to supports 62 at joint 66 and to hood 58 at joint 68.

The rearward face 69 of hood 58, which abuts the forward face 70 of slagging manifold 50 when hood 58 is in its lowered, charging position, has one or more openings therein which register with the openings in the abutting face 70, thereby connecting charging hood 58 to the main fumes exhaust system. Hood 58 also has a central circular aperture through the top face thereof in registry with the furnace mouth to allow passage of a charging bucket 71 therethrough for charging the furnace. As the bottom of charging bucket 71 opens to dump the metal charge into the furnace, dust and fumes evolved thereby are swept into the fumes exhaust system by air passing through an opening 72 in the front face of charging hood 58.

An additional advantage of the fumes exhaust system thus presented is that the system leaves open the operating side of the arc melting furnace, the operating side being that side illustrated in FIG. 1.

This fumes control system thus provides for immediate or close capture of fumes and dust arising during furnace operation. Fumes evolved during tapping of the furnace are drawn from spout 16 into the closely overlying exhaust hood 24, through connecting duct 28 and manifold and hood 26 and then through the connecting ductwork 25 into the main fumes exhaust duct 42, 44, 46.

Similarly, fumes evolved during melting operations are swept from the vicinity of the roof 12 perforations through which electrodes 14 pass by air flowing under manifold and hood 26. The captured melting fumes are then conducted through ductwork 25 into the main fumes exhaust duct.

Fumes released during the slagging operation from slagging door 18 are drawn immediately upwardly into closely overlying slagging exhaust hood 48 and then into exhaust manifold 50 to be conducted away through ductwork 52, 54, 56, 38 and 40 into the main fumes exhaust duct.

When roof 12 and manifold and hood 26 and tapping hood 24 are moved away from the furnace and charging hood 58 is moved into closely overlying relationship therewith for charging, air drawn between hood 58 and crucible 10 immediately sweeps dust and fumes created through mating passageways in rearward surface 69 and forward surface 70. The fumes and dust are conducted through ductwork 52, 54, 56, 38 and 40 into the main fumes exhaust system.

Referring now to the furnace fumes exhaust control system illustrated in FIGS. 4–5, those elements which perform the same or similar functions as the elements presented in the preceding discussion of the exhaust control system of FIGS. 1–3 are numbered identically. In FIGS. 4–5, crucible 10 of the electric arc furnace has an upwardly directed mouth covered during melting operations by roof 12, a tapping spout 16 covered by a tapping fumes exhaust hood 24, and a slag door (not shown) covered by a slagging fumes exhaust hood 48.

A plurality of electrodes 14 supply electricity for melting metal in the furnace, electrodes 14 protruding through roof 12 into the interior of the furnace. Roof 12 in this embodiment is adapted for removal from the furnace mouth by a member 113 which member is mounted upon the side of crucible 10. Member 113 projects roof 12 vertically upwardly and then moves roof 12 transaxially to a position out of registry with the furnace mouth by pivoting it about the central axis of member 113 along dotted line 114. Roof 12 is attached to pivot member 113 by a plurality of support members 115.

Attached to roof 12 is a melting fumes exhaust hood 126. Provision is made in the top of hood 126 for electrodes 14 and an exhaust duct 127 opens interiorly of hood 126. At the end of exhaust duct 127 remote from hood 126 is a mating flange 125.

In the furnace of this embodiment, crucible 10 is mounted upon a pair of trunnions 122, the crucible being tilted by a conventional tilting mechanism 20. In this embodiment of the invention, duct section 46, the other end of which is connected to the exhaust fan means (not shown) is coaxial with the tilt axis of crucible 10, i.e., the pivotal axes of trunnions 122. Attached to duct section 46 by swivel 40 is a main fumes exhaust duct 124 which first executes a right angle bend to run rearwardly of crucible 10 from swivel 40 and then executes a second right angle bend to run vertically upwardly, terminating in a main fumes exhaust manifold 128. Main fumes exhaust manifold 128 is mounted upon the side of crucible 10 by one or more diagonal support members 129.

Tapping fumes exhaust manifold 24, which overlies tapping spout 16, is connected to main fumes exhaust manifold 128 by a duct section 130, a controllable damper 132 and a duct section 134. Slagging fumes exhaust hood 48 is attached to main fumes exhaust manifold 128 by a duct section 152, a controllable damper 154 and a duct section 156. Dampers 132 and 154 are controllable to vary their rates of withdrawal of fumes from tapping fumes exhaust hood 24 and slagging fumes exhaust hood 48 respectively.

A mating surface 160 is provided along the side of main fumes exhaust manifold 128 which opens toward crucible 10.

The charging hood 58 of the embodiment of FIGS. 4–5 is attached to a floor mounted member 162 by a plurality of supporting arms 164 for projecting vertically upwardly and downwardly along the axis of member 162 and for pivoting about said axis into a position in registry with the mouth of crucible 10 as indicated by line 165 of FIG. 4 for charging the furnace. The central opening 168 in charging hood 58 is provided for entry of the charging bucket 71 into the furnace for charging purposes as indicated by dashed lines 171, 172. Along the outer periphery of charging hood 58 is a fumes exhaust duct 175 terminating in a mating surface 178 similar to the mating surface 125 on fumes exhaust duct 127 of melting hood 126. Mating surfaces 125, 178 are proportioned and designed sealingly to engage mating surface 160 when roof 12 and charging hood 58, respectively, are moved into engagement with the furnace mouth.

During the charging operation, when charging hood 58 engages the mouth of crucible 10, and charging bucket 71 is lowered into opening 158, fumes are withdrawn from the interior of the furnace and flow through duct 175, past the junction of mating surfaces 160 and 178, into the main fumes exhaust manifold 128, through main fumes duct 124 and into duct 46.

After charging is completed, charging hood 58 is first projected vertically upwardly along the axis of member 162 and then moved transaxially to a position out of registry with the mouth of crucible 10 along dotted line 165 to its storage position illustrated in FIG. 4. Then roof 12 and melting fumes exhaust hood 126 with its exhaust duct 127 are pivoted about the axis of member 113 along dotted line 114 into a position in registry with the mouth of crucible 10 and projected vertically downwardly along the axis of member 113 to close crucible 10. With the elements of the furnace and fumes control system in this position, mating surfaces 125 and 160 are engaging. As melting begins, fumes from the melting operation are withdrawn from the furnace through hood 126, duct 127, past the junction of surfaces 125, 160, and through main fumes exhaust manifold 128, main fumes exhaust duct 124 and duct 46.

As in the preceding embodiment, fumes evolved during the tapping operations are captured under tapping fumes exhaust hood 24 and are carried away through duct sections 130 and 134 into the main fumes exhaust manifold 128. Similarly, fumes evolved during the slagging operation are captured under slagging fumes exhaust hood 48 and are ducted away through duct sections 152 and 156 into the main fumes exhaust manifold 128. Of course, conduction of fumes from either tapping fumes exhaust hood 24 or slagging fumes exhaust hood 48 may be inhibited by closing dampers 132, 154 respectively.

As can be seen from the preceding examples, the hood or manifold with which the charging hood is interchangeable may be used exclusively to capture fumes generated during the melting operation, as is the case in the embodiment presented in FIGS. 4–5, or it may be connected to one or more other fumes exhaust hoods, e.g., the tapping fumes exhaust hood, as is the case in the embodiment of FIGS. 1–3. Similarly, the fumes exhaust hood or manifold with which the charging hood is interchangeable can have one or more connecting flanges which allow it to be coupled to one or more other elements in the fumes exhaust control ssytem. As exemplified by the two disclosed embodiments, the fumes exhaust control system can be flexibly coupled to the exhaust fan means by tailoring the connecting duct work to the specific requirements of a particular furnace. See, for example, the distinct arrnagements of swivel 40 and duct elements 42–46 of the embodiment of FIGS. 1–3 and swivel 40 and duct 46 of the embodiment of FIGS. 4–5.

Further, as the disclosed embodiments illustrate, the charging hood itself may be mounted upon the furnace as in the embodiment of FIGS. 1–3, or, alternatively, it may be mounted upon an independent base, e.g., support member 162 of FIGS. 4–5. Additionally, as the two disclosed embodiments illustrate, the charging hood may be moved into and out of engagemennt with the furnace mouth by a linear actuator such as a hydraulic cylinder 64 of the embodiments of FIGS. 1–3 or by rotary actuator such as the pivotal member 162 of the embodiments of FIGS. 4–5. Of course, the actuator could be regulated by any desired means, e.g., pneumatic, hydraulic or electrical.

It may be seen that the disclosed "close capture" fumes control systems provide apparatus for immediately capturing any fumes or dust generated during any phase of operation of the arc furnace. All fumes and dust are thus prevented from escaping and may be conducted away through the main fumes exhaust system to a point where solids may be precipitated and harmful and deleterious gaseous pollutants may be separated from the effluent fumes before final exhaustion of the gas into the environment. An additional and significant advantage of close capture arrangements of the type herein presented is that considerably less air volume is required to insure complete withdrawal of fumes and dust from the furnace into the exhaust system. The significant decrease in air volume required results in economies in exhaust fan capacity as well as ductwork capacity.

What is claimed is:

1. A fumes control system for an electric arc furnace comprising a crucible providing an upwardly directed mouth, a roof covering said mouth, said roof being movable into an opening position away from said mouth, a plurality of arc electrodes extending downwardly through said roof, said crucible having at least one pouring spout opening therein and being tiltable for tapping and for removing slag therefrom, said control system comprising exhaust means, first hood means for collecting fumes generated during furnace operations from said roof, first conduit means for connecting said first hood means to said exhaust means, said first hood means being movable with said roof to expose said mouth, said first conduit means providing for such movement of said first hood means, and charging hood means for covering said mouth when said first hood means and said roof are moved away from said mouth, said charging hood means having a use position covering said mouth and a storage position away from said mouth, means for supporting said charging hood means for movement between said positions, second conduit means for connecting said charging hood means to said exhaust means when said charging hood means is in said use position, and said charging hood means having an opening therein through which said crucible is charged with metal to be melted.

2. A fumes control system according to claim 1 wherein said cricuble has a pouring spout opening forwardly and a slagging port opening rearwardly, said crucible being tiltable forwardly to tap said furnace through said spout and rearwardly for removing slag from said port, third hood means for collecting fumes from said pouring spout, fourth hood means for collecting fumes from said slagging opening, said fourth hood means being mounted on said crucible for tilting movement therewith, conduit means for connecting said fourth hood means to said exhaust means, the last conduit means being disposed to accommodate the tilting movement of said crucible, and said charging hood means being in communication with said exhaust means through said fourth means when said charging hood means is in said use position.

3. A fumes control system according to claim 2 wherein selectively controllable damper means are connected between said third hood means and said exhaust means for controlling exhaust flow from said third hood means and selectively controllable damper means are connected between said fourth hood means and said exhaust means for controlling exhaust flow from said fourth hood means.

4. A fumes control system according to claim 2 wherein said exhaust means comprises exhaust fan means, a main fumes exhaust duct swivellingly and telescopically connected to said exhaust fan means at a first end and swivellingly connected to said first and second conduit means at its second end for allowing said first and second hood means to remain connected to said exhaust means while said crucible tilts for pouring and slag removal.

5. A fumes control system according to claim 1 wherein said crucible has a pouring spout opening forwardly and a slagging port opening rearwardly, said crucible being tiltable forwardly to pour through said spout and rearwardly for removing slag from said port, third hood means for collecting fumes from said pouring spout, third conduit means for connecting said third hood means to said exhaust means, fourth hood means for collecting fumes from said slagging opening, fourth conduit means for connecting said fourth hood means to said exhaust means, said third and fourth hood means being mounted on said crucible for tilting movement therewith.

6. A fumes control system according to claim 5 wherein selectively controllable damper means are connected between said third hood means and said exhaust means for controlling exhaust flow from said third hood means and selectively controllable damper means are connected between said fourth hood means and said exhaust means for controlling exhaust flow from said fourth hood means.

7. A fumes control system according to claim 5 wherein said exhaust means comprises exhaust fan means, a main fumes exhaust duct connected thereto at a first end and swivellingly connected to main fumes exhaust manifold means at its second end for allowing said third and fourth hood means to remain connected to said exhaust means while said crucible tilts for pouring and slag removal.

8. In a fumes exhaust system for use with a furnace having a crucible with an upwardly directed mouth covered by a roof, and means coupled to said roof for projecting said droof vertically upwardly along an axis and pivotally about said axis to a position out of registry with said mouth for providing access thereto for charging said furnace, means for tilting said furnace for tapping and slagging, said fumes exhaust system comprising exhaust means, first hood means movable with said roof to a position out of registry with said mouth, first conduit means for connecting said first hood means to said exhaust means, and charging hood means adapted for movement into close, overlying relationship with said mouth when said first hood means are withdrawn from registry therewith, means for moving said charging hood into, and retracting said charging hood from, close overlying relationship with said mouth, said charging hood having a top with an opening therein for passage of a charging bucket therethrough and second conduit means for coupling said charging hood to said exhaust means when said charging hood is in overlying relationship with said mouth, said charging hood having means therein disposed to provide air movement past said mouth, and into said exhaust means for exhausting fumes and dust generated during charging of said furnace.

9. A fumes exhaust system according to claim 8 wherein said means for moving said charging hood into, and retracting said charging hood from, close overlying relationship with said mouth comprises support means mounted on said crucible and actuator means pivotally attached to said means and to said charging hood for moving said hood.

10. A fumes exhaust system according to claim 8 wherein said means for moving said charging hood into, and retracting said charging hood from, close overlying relationship with said mouth comprises support means mounted remote from said crucible, said support means having a pivotal axis for pivoting said charging hood into registry with said mouth, said support means further being adapted for axially projecting said charging hood downwardly into close overlying relationship with said mouth.

11. A fumes control system for use with a metal melting furnace comprising a crucible tiltable forwardly for tapping and rearwardly for slag discharge and having a tapping spout and a slag discharge port in a sidewall thereof and an upwardly directed mouth and a roof covering said mouth, said roof adapted for movment to a position out of registry with said mouth for charging said furnace, and means connected to said roof for moving it to a position out of registry with said mouth, said fumes control system comprising exhaust means, first hood means connected to said exhaust means and closely spaced to said roof for capturing fumes generated during melting of metal in said furnace, said first hood means being movable with said roof to a position out of registry with said mouth, manifold means connected to said exhaust means, and second hood means having a storage position out of overlying relationship with said mouth and a use position in overlying relationship with said mouth when said roof and first hood means are removed from registry therewith, means for moving said second hood means from said storage position to said use position, said second hood means including a top having an opening therein for movement into registry with said mouth for charging said furnace therethrough, said second hood means having means communicating with said manifold means when in said use position and means for drawing air past said opening and said mouth when in said use position.

12. A fumes control system according to claim 11 wherein said first hood means comprises tapping and melting manifold and hood means including a tapping hood disposed in close overlying relationship with said tapping spout for capturing fumes released therefrom during tapping of said furnace, a melting hood disposed in close overlying relationship with said roof for capturing fumes released therefrom during melting and a manifold connected to said tapping hood and to said melting hood and flexibly connected to said exhaust means for remaining connected thereto when said furnace is tilted for tapping and when said roof and first hood means are removed therefrom for charging of said furnace.

13. A fumes control system according to claim 11 wherein said manifold means comprises a slagging manifold and hood mounted upon said crucible, said hood being disposed closely adjacent said slag discharge port for capturing fumes generated during slag discharge from said furnace, said slagging hood being connected to said slagging manifold and said slagging manifold being fixedly connected to said exhaust means for remaining connected thereto when said furnace is tilted for slag discharge, said slagging manifold having a first engaging surface, and said second hood means comprises a charging hood adapted for movement from said storage position to said use position and having a second engaging surface, said first and second engaging surfaces for engaging said charging hood and slagging manifold and said communicating means comprising means in said second engaging surface for connecting said charging hood to said slagging manifold.

14. A fumes control system according to claim 11 wherein said second hood means is pivotally connected to said crucible and said means for moving said second hood means comprises support means mounted on said crucible and hydraulic cylinder means pivotally connected to said support means and to said second hood means and actuable for moving said second hood means into said storage and use positions.

* * * * *

PO-1050
(5/69)

UNITED STATES PATENT OFFICE
CERTIFICATE OF CORRECTION

Patent No. 3,979,551 Dated September 7, 1976

Inventor(s) Robert C. Overmyer and Pramodh Nijhawan

It is certified that error appears in the above-identified patent and that said Letters Patent are hereby corrected as shown below:

Column 1, line 44, "duct" should be -- dust --.
Column 2, line 6, "slapping" should be -- slagging --.
Column 8, line 1, after "fourth" insert -- hood --;
Same column, line 52, "droof" should be -- roof --.
Column 10, line 27, "fixedly" should be -- flexibly --.

Signed and Sealed this

Twenty-third Day of November 1976

[SEAL]

*Attest:*

RUTH C. MASON
*Attesting Officer*

C. MARSHALL DANN
*Commissioner of Patents and Trademarks*